United States Patent [19]

Machin

[11] 4,231,904

[45] Nov. 4, 1980

[54] DETERGENT BARS WITH IMPROVED PROPERTIES

[75] Inventor: David Machin, South Wirral, England

[73] Assignee: Lever Brothers Company, New York, N.Y.

[21] Appl. No.: 15,496

[22] Filed: Feb. 26, 1979

[30] Foreign Application Priority Data

Mar. 1, 1978 [GB] United Kingdom ..... 8079/78

[51] Int. Cl.[2] ..... C11D 1/28; C11D 17/00

[52] U.S. Cl. ..... 252/557; 252/121; 252/174; 252/174.21; 252/DIG. 16

[58] Field of Search ..... 252/89, 108, 121, 134, 252/174, 557, DIG. 16

[56] References Cited

U.S. PATENT DOCUMENTS

| | | | |
|---|---|---|---|
| 2,894,912 | 7/1959 | Geitz | 252/121 |
| 3,248,333 | 4/1966 | O'Roark | 252/144 |
| 3,376,229 | 4/1968 | Haass et al. | 252/117 |
| 3,689,437 | 9/1972 | McLaughlin | 252/557 |
| 3,766,097 | 10/1973 | Rosmarin | 252/552 |
| 3,867,301 | 2/1975 | Watanabe et al. | 252/108 |
| 3,879,309 | 4/1975 | Gatti et al. | 252/117 |
| 3,988,255 | 10/1976 | Seiden | 252/107 |
| 4,007,125 | 2/1977 | Prince | 252/117 |
| 4,100,097 | 7/1978 | O'Roark | 252/145 |
| 4,148,743 | 4/1979 | Schubert | 252/132 |

FOREIGN PATENT DOCUMENTS

| | | | |
|---|---|---|---|
| 561001 | 7/1958 | Canada | 252/557 |
| 58-005 | 8/1973 | Japan | 252/DIG. 16 |

*Primary Examiner*—P. E. Willis, Jr.

*Attorney, Agent, or Firm*—James J. Farrell; Melvin H. Kurtz

[57] ABSTRACT

Detergent bars containing acyl isethionates can exhibit a feeling of drag (relatively high friction) when handled during washing. The drag can be reduced, and therefore the slip feeling of the bar improved, by adding an ethosylated sorbitan ester. Preferably the amount of ester is from about 5% to about 30% by weight of the bar.

9 Claims, No Drawings

DETERGENT BARS WITH IMPROVED PROPERTIES

This invention relates to detergent bars intended for personal washing having acyl isethionates as a major constituent.

Acyl isethionates are known ingredients for detergent bars for personal washing and are the water soluble salts of isethionic acid after acylation. The acyl group being derived from fatty acids containing from about 6 to about 22 carbon atoms. The fatty acids can be obtained from natural or synthetic sources, preferably acids in the range $C_{12}$–$C_{18}$ are used. The acids providing the acyl group are normally mixtures of long chain acids and examples of their natural sources are coconut oil, olive oil, palm kernel oil, tallow and fish oils. Synthetic sources of the feedstock acids are exemplified by products of the Koch or Oxo processes.

The salts will usually be the sodium or potassium salts or mixtures thereof. The sodium salt is that normally used in commercial products but salts of ammonium and alkyl ($C_1$ to $C_4$) substituted ammonium, amine and alkanolamine may also be used. The acyl isethionates may be prepared by any of the methods described in the literature.

The present invention proposes the use of ethoxylated sorbitan esters to improve the slip characteristics of a detergent bar containing acyl isethionates as a major constituent, the resultant bar having a mild action on skin. The slip properties of a bar are noted in use by subjective assessment and are demonstrable also by instrumental methods. Ethoxylated sorbitan esters are disclosed as components of soap bars in U.S. Pat. No. 3,988,255.

A detergent bar of the invention contains from about 20% to about 70% of water soluble salts of acyl ($C_8$ to $C_{22L}$) isethionates based upon the detergent active by weight of the total bar and an amount of ethoxylated (about 1 to about 30 units) sorbitan ester (about $C_{12}$ to about $C_{22}$) effective to increase the slip properties of the bar.

Preferred limits of the components are above about 30% and below about 60% for the acyl isethionates, and above about 5% and below about 30% for the ethoxylated sorbitan esters, more preferably the latter component is present above about 10% and below about 25% by weight of the bar.

The ethoxylated sorbitan esters used in the bars of the invention comprise mixed mono-, di- and higher esters of 1, 4-, 3,6-, 2,5-, and 1,5- sorbitan with fatty acids. The preferred average degree of ethoxylation is above about 4 units and below about 20 units. The esters used will contain amounts of sorbitol ethoxylate and isosorbide esters together with free sorbitol. Ethoxylated sorbitan esters are available commercially from Atlas Chemical Industries Inc of Wilmington, Delaware USA under the Registered Trade Mark "Tween".

The chemical preparation and properties of ethoxylated sorbitan esters are documented in the literature and reference is made to (i) Proceedings of Scientific Section of the Toilet Goods Association December 1963 in the article by Dr. J. F. Treon beginning at page 40, (ii) Journal of the American Oil Chemists Society volume 45 (October 1968) in the article entitled "Emulsifiers: Processing and Quality Control" by MacDonald, and (iii) U.S. 3,988,255 (P. Seiden assigned to The Procter & Gamble Company).

The disclosures in these previous publications are incorporated herein by reference.

The fatty acid used to esterify the sorbitan will be an individual compound or a mixture of acids. The reacting acids giving the desired esters will contain from about 12 to about 22 carbon atoms. The alkyl or alkenyl group of the fatty acid or acids may contain a degree of branching and preferably contains from about 16 to about 18 carbon atoms.

The proportions quoted herein refer to the amounts of ethoxylated sorbitan esters present in bars, even when an impure feedstock is used.

Optional ingredients in the detergent bars include perfume, stabilising agents (for example ethylene diamine tetra-acetic acid and ethane-1-hydroxydiphosphonic acid), pigments, fillers, opacifiers and plasticisers. An amount of water will be present to provide suitable physical properties, this amount is usually in the range from about 5% to about 15%. Optionally the bars will also include other components to upgrade bar performance, eg, lather, while not impairing the mild detergent action on the skin when used in personal washing. Examples of optional ingredients are anionic detergent actives selected from the group water soluble salts of long chain ($C_6$ to $C_{22}$) fatty acids, alkyl ($C_{12}$ to $C_{18}$) sulpho-acetates, dialkyl ($C_6$ to $C_9$) sulphosuccinates monoalkyl ($C_{10}$ to $C_{20}$) ethoxylated sulphosuccinates, ($C_{12}$ to $C_{18}$) methyl taurides, acyl ($C_{10}$ to $C_{20}$) glutamates, alkyl ($C_{12}$ to $C_{18}$) ether sulphates, alkyl ($C_{10}$ to $C_{22}$) sulphates and olefin ($C_{10}$ to $C_{14}$) sulphonates. These mild anionic actives will, in general, possess a sulphonate, sulphate and/or carboxylate head group with ester, ether or amide linkages in the vicinity of the head group, this structure being conducive to a mild action on the skin.

The amount of these actives in the total formulation will be in the range of 0% to about 50%, preferably from about 10% to about 40%.

A second optional ingredient is an emollient material which will be present in an amount of 0% to about 40%, preferably from about 5% to about 20%. These emollients are water insoluble oily and waxy materials known for their cosmetic benefits on skin.

Preferred emollient materials include waxy or oily fatty alcohols, fatty glycols and diols, fatty polyols and fatty acid esters. Examples of these emollients are $C_{12}$ to $C_{22}$ fatty alcohols, $C_{12}$ to $C_{18}$ fatty acids, ethoxylated (3EO and 18EO) long chain ($C_{12}$ to $C_{18}$) alcohols, ethoxylated (3EO to 12EO) fatty acids ($C_{12}$ to $C_{18}$), esters ($C_1$ to $C_4$) of $C_{12}$ to $C_{18}$ fatty acids eg, isopropyl myristate, poly-ethylene glycols (molecular weights in the range 200 to 5,000) and silicone oils.

Examples of detergent bars according to present invention will now be described to illustrate but not limit the invention.

EXAMPLE I

Sodium acyl (hardened coconut) isethionate was mixed with substantially pure ethoxylated sorbitan ester in the weight ratio of 3:1. The ethoxylated sorbitan ester was obtained from Honeywill-Atlas Ltd of Carshalton, Surrey, England, under the trade name Tween 65 (Polyoxyethylene (20) sorbitan tristearate). The mixture was then milled between rollers and passed through two stages of plodder extruders. The resulting continuous log of soap was cut into billets and stamped to form bars. These bars were used as test bars and compared with bars prepared from the acyl isethionate base only.

The slip characteristics of the Test and Control bars were examined by a panel who used both bars for hand washing. The panel identified the test bar as having an increased slip feel characteristic compared to the Control bar.

The slip characteristic were also examined using an instrumental method to measure the reduction in surface friction achieved by the addition of ethoxylated sorbitan ester. The bar being examined was fixed to the underside of a beam (downwardly biased by 50 g) with a strain gauge attached to the beam.

The test was performed at 40° C. and water at this temperature was allowed to flow over the lower surface of the bar.

A finger was then moved along the under surface and the signal generated by the strain gauge displayed on a recorder. The amplitude of the signal, which is proportional to the friction between the surface and the finger, was measured. It was found the average signal was higher with the Control bar (9.08 units) compared with the Test bar (5.60 units) showing the Test bar had more slip.

EXAMPLE II

Samples of five Test bars and a Control bar were prepared. Two ethoxylated sorbitan esters were used in the Test bars. Compound I was the ester used in Example I and compound II was polyoxyethylene (20) sorbitan monostearate; the latter is obtainable under the trade name Tween 60 from Honeywill-Atlas Ltd. The compositions of the five Test bars are given in Table I. The base mixture was the Control bar formulation.

TABLE I

| Test bar | base mixture | ethoxylated sorbitan ester | % by weight in product. acyl isethionate | ethoxylated sorbitan ester |
|---|---|---|---|---|
| A | 90% | 10% (Compound II) | 45% | 10% |
| B | 90% | 10% (Compound I) | 45% | 10% |
| C | 80% | 20% (Compound II) | 40% | 20% |
| D | 80% | 20% (Compound I) | 40% | 20% |
| E | 70% | 30% (Compound I) | 35% | 30% |
| The Control bar had the composition by weight: | | | | |
| sodium acyl (hardened coconut) isethionate | | | | 50% |
| sodium dodecyl benzene sulphonate | | | | 2% |
| sodium soap | | | | 11% |
| sodium isethionate | | | | 5% |
| free fatty acids ($C_8$ to $C_{22}$) | | | | 24% |
| moisture | | | | 6% |
| remainder | | | | 2% |

The slip characteristics of the Test and Control bars were examined by a panel of 16 persons who used pairs of bars for hand washing in sequence and then identified the bar with the highest slip during use. Hands were washed in running water at about 30° C. for 10 seconds then rinsed for 5 seconds; the process was then repeated for another bar. Each pannellist compared each pair of bars (Test/Control) twice. The numbers of panellists identifying the bar in each pair as having more slip are given in Table II.

TABLE II

| | Test bar | Control bar | No difference |
|---|---|---|---|
| Bar A | 17 | 6 | 9 |
| Bar B | 26 | 4 | 2 |
| Bar C | 22 | 7 | 3 |
| Bar D | 29 | 2 | 1 |
| Bar E | 22 | 8 | 2 |

This data is statistically significant at a confidence level of below 0.01 for bars B, C and D and at a confidence level of 0.05 for bars A and F.

These results demonstrate the addition of ethoxylated sorbitan esters to acyl isethionate containing detergent bars reduces the in-use drag which is an acknowledged feature of these bars.

What is claimed is:

1. A detergent bar containing from about 20% to about 70% by weight of water soluble salts of acyl ($C_8$ to $C_{22}$) isethionates and an amount of ethoxylated (about 1 to about 30 units) sorbitan ester, having from about 12 to about 22 carbon atoms in the acid derived portion effective to increase the slip properties of the bar.

2. A detergent bar according to claim 1 containing from about 5% to about 30% by weight of ethoxylated sorbitan ester.

3. A detergent bar according to claim 1 or 2 containing above about 30% by weight of acyl isethionate.

4. A detergent bar according to claim 3 containing below about 60% by weight of acyl isethionate.

5. A detergent bar according to claim 1 containing above about 10% by weight of ethoxylated sorbitan ester.

6. A detergent bar according to claim 5 containing below about 25% by weight of ethoxylated sorbitan ester.

7. A detergent bar according to claim 1 wherein the alkyl or alkenyl group of the ethoxylated sorbitan ester contains from about 16 to about 18 carbon atoms.

8. A detergent bar according to claim 1 wherein the ethoxylated sorbitan ester contains above about 4 units of ethylene oxide.

9. A detergent bar according to claim 8 wherein the ethoxylated sorbitan ester contains below about 20 units of ethylene oxide.

* * * * *

UNITED STATES PATENT AND TRADEMARK OFFICE

CERTIFICATE OF CORRECTION

PATENT NO. : 4,231,904

DATED : November 4, 1980

INVENTOR(S) : David Machin

It is certified that error appears in the above-identified patent and that said Letters Patent are hereby corrected as shown below:

On line 5 of the Abstract, delete "ethosylated" and insert therefor -- ethoxylated --.

Signed and Sealed this

*Twenty-first* Day of *April 1981*

[SEAL]

*Attest:*

RENE D. TEGTMEYER

*Attesting Officer*

*Acting Commissioner of Patents and Trademarks*